US005147043A

United States Patent [19]

Gould

[11] Patent Number: 5,147,043

[45] Date of Patent: Sep. 15, 1992

[54] COLLECTOR CARD DEVICE FOR STAMP COLLECTORS

[76] Inventor: John C. Gould, 12 Mine Hill Rd., West Reading, Conn. 06896

[21] Appl. No.: 712,704

[22] Filed: Jun. 10, 1991

[51] Int. Cl.[5] ..... B65D 73/00

[52] U.S. Cl. ..... 206/457; 40/124.1; 206/39; 206/460; 206/459.5

[58] Field of Search ..... 40/1, 124.1, 299, 360, 40/594, 638; 206/37, 39, 232, 457, 459, 460; 229/92.8

[56] References Cited

U.S. PATENT DOCUMENTS

| | | | |
|---|---|---|---|
| 201,769 | 3/1878 | Fox | 40/638 |
| 1,247,517 | 11/1917 | Ellis | 206/459 |
| 4,012,857 | 3/1977 | Leskovec, Jr. | 40/299 |
| 4,641,578 | 2/1987 | Versaci | 40/638 |

FOREIGN PATENT DOCUMENTS

| | | | |
|---|---|---|---|
| 0450726 | 10/1927 | Fed. Rep. of Germany | 40/638 |
| 0191983 | 10/1937 | Switzerland | 40/638 |
| 0018143 | of 1889 | United Kingdom | 40/638 |

*Primary Examiner*—Jimmy G. Foster

[57] ABSTRACT

A collector card device for stamp collectors includes a collector card having opposite front and rear surfaces. The front surface of the card carries a reproduction of the front surface of a selected postage stamp issued by an appropriate organization. The stamp has a gummed rear surface. The rear surface of the card carries explanatory data applicable to said reproduction and also is provided with a region spaced from the data for detachably receiving the rear surface of said stamp. The rear surface of the stamp is detachably secured to the region on the rear surface of the card.

2 Claims, 1 Drawing Sheet

FIG. 1
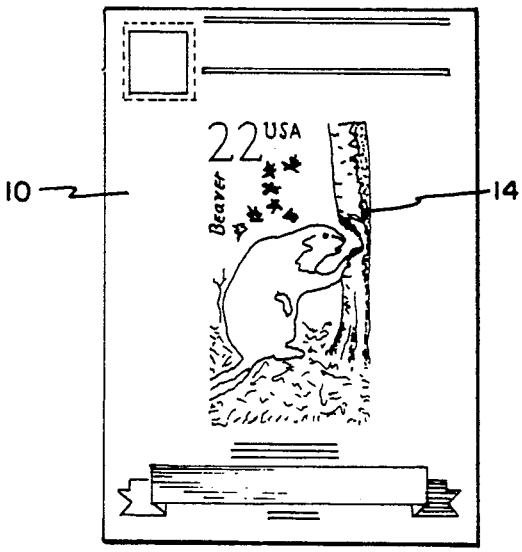
FIG. 2
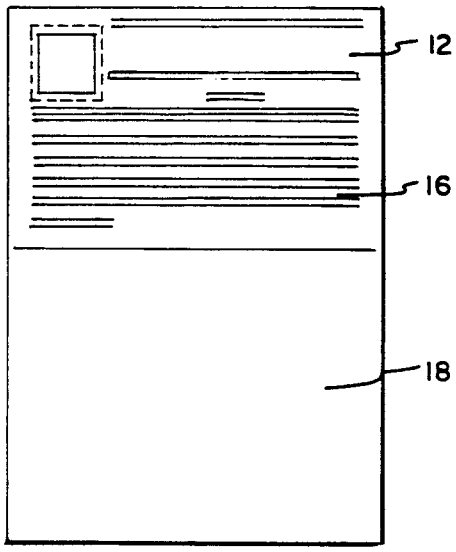
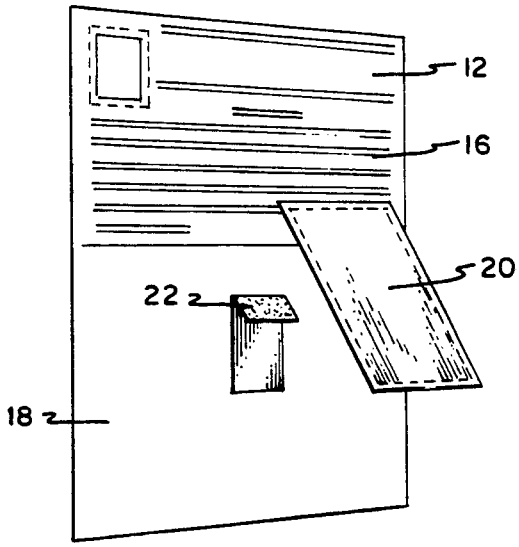
FIG. 3

COLLECTOR CARD DEVICE FOR STAMP COLLECTORS

BACKGROUND OF THE INVENTION

Baseball cards carrying pictures of one or more professional baseball players are well known and are widely collected by interested hobbyists. Other hobbyists who collect postage stamps conventionally use stamp albums in which stamps are detachably secured in appropriately assigned spaces on separate album pages.

The present invention is directed toward a new type of card device adapted for use by stamp collectors. This new card device will enable stamp collectors to collect cards carrying reproductions of postage stamps and to secure stamps to be collected to such cards.

SUMMARY OF THE INVENTION

In accordance with the principles of this invention, a collector card device for stamp collectors employs a collector card having oppositely disposed front and rear surfaces. The front surface carries a reproduction of the front surface of a selected postage stamp issued by an official post office organization such as the United States Postal Service or an equivalent organization of another stamp issuing country. The rear surface of the card carries data uniquely associated with the subject of the reproduction. The rear surface is also provided with a region to which the selected stamp can be secured. Means such as a stamp hinge can be employed to detachably secure the rear surface of the selected stamp to this region on the rear surface of the card.

Consequently, a stamp collector can display the front surface of the card which carries the desired reproduction and can also display the rear surface of the card with the actual stamp and the associated data.

BRIEF DESCRIPTION OF THE DRAWINGS

FIG. 1 is a front view of a card displaying a reproduction of a selected postage stamp.

FIG. 2 is a rear view of the card shown in FIG. 1 before a postage stamp has been detachably secured thereto.

FIG. 3 is a rear perspective view of the card of FIG. 1 with a postage stamp detachably secured thereto.

DETAILED DESCRIPTION OF PREFERRED EMBODIMENTS

Referring now to FIGS. 1-3, a thin flat durable plastic or cardboard card, typically about two and one half inches wide and about three and one half inches long and about one sixteenth inch thick, has a front surface 10 and a rear surface 12. The front surface carries a reproduction 14 of the front surface of a United States postage stamp displaying a beaver and having a displayed value for postage uses of $0.22. The rear surface has written data 16 concerning beavers imprinted on the top half of the surface. The bottom half of the rear surface is a blank region 18.

An actual stamp 20 whose front surface is reproduced as 14 on the front surface of the card has its gummed rear surface detachably secured to the blank region 18 of the rear surface of the card by stamp hinge 22.

Collectors who do not wish to use stamp hinges can use other well known means such as transparent envelopes which can be secured to the blank region and stamps can be removably inserted in such envlopes.

Stamps of other countries can be used in place of the United States stamp shown, and the data and other written material can be in languages other than English.

While the invention has been described with particular reference to the drawings, the protection sought is to be limited only by the terms of the claims which follow.

What is claimed is:

1. A collector card device for stamp collectors comprising:

a postage stamp issued by an appropriate organization and having a gummed rear surface;

a thin flat durable collector card having opposite front and rear surfaces, the front surface carrying a reproduction of the front surface of said stamp, the rear surface of the card carrying explanatory data applicable to said reproduction and also having a region spaced from the data; and a stamp hinge for detachably securing the rear surface of the stamp to the region on the rear surface of the card.

2. The device of claim 1 wherein the stamp is a postage stamp issued by the United States postal service.

* * * * *